US005452958A

United States Patent [19]

Aruga et al.

[11] Patent Number: 5,452,958

[45] Date of Patent: Sep. 26, 1995

[54] DRIVE COIL PROTECTION APPARATUS AND METHOD AND PRINTER INCORPORATING THE APPARATUS

[76] Inventors: Kazuhisa Aruga; Yoshiaki Fukuda, both of 3-5 Owa 3-chome, c/o Seiko Epson Corporation, Suwa-shi, Nagano-ken 392, Japan; Yoshikazu Ito, all of Suwa, Japan

[21] Appl. No.: 27,213

[22] Filed: Mar. 5, 1993

[30] Foreign Application Priority Data

Mar. 6, 1992 [JP] Japan ..... 4-49674

[51] Int. Cl.[6] ..... B41J 9/50

[52] U.S. Cl. ..... 400/124.03; 400/157.2

[58] Field of Search ..... 400/54, 157.2, 400/157.3, 166, 74, 124 TC, 124.02, 124.03, 124.07, 120.11

[56] References Cited

U.S. PATENT DOCUMENTS

| | | | |
|---|---|---|---|
| 4,540,295 | 9/1985 | Okunishi | 400/124 TC |
| 5,042,375 | 8/1991 | Grüner et al. | 400/124.03 |
| 5,054,941 | 10/1991 | Koike et al. | 400/124.03 |
| 5,152,619 | 10/1992 | Niikawa et al. | 400/124.03 |

FOREIGN PATENT DOCUMENTS

| | | | |
|---|---|---|---|
| 176732 | 4/1986 | European Pat. Off. | 400/120 |
| 401820 | 12/1990 | European Pat. Off. | 400/120 |
| 263773 | 11/1986 | Japan | 400/120 |
| 62770 | 3/1987 | Japan | 400/157.2 |
| 281867 | 11/1988 | Japan | 400/120 |
| 306049 | 12/1988 | Japan | 400/124 TC |
| 36475 | 2/1989 | Japan | 400/157.2 |
| 58561 | 3/1989 | Japan | 400/157.2 |
| 1255569 | 10/1989 | Japan | 400/120 |
| 10942 | 1/1990 | Japan | 400/157.2 |
| 227263 | 9/1990 | Japan | 400/157.2 |

*Primary Examiner*—David A. Wiecking
*Assistant Examiner*—Steven S. Kelley
*Attorney, Agent, or Firm*—Harold T. Tsiang

[57] ABSTRACT

The invention provides an drive coil protection apparatus and method and a printer incorporating the apparatus. A rank memory stores a preset rank value associated with a reference drive coil in the print head of a printer. The preset rank value characterizes inherent deviations associated with the reference drive coil. The deviations result from manufacturing process, etc. A judgment value memory stores a plurality of sets of mode judgment values. Each set of mode judgment values corresponds to a particular rank value. Each mode judgment value represents a threshold value for determining the.thermal condition of the print head and for selecting an appropriate operating mode for the print head. A head information detector detects the voltage drop across the reference drive coil to measure the change in the resistance of the reference drive coil. The voltage drop is digitized for accuracy measurement. The change in temperature of the reference drive coil can thus be determined. An operating mode selection circuit compares the digitized voltage drop with a particular set of mode judgment values in the judgment value memory corresponding to the preset rank value. Then, the operating mode selection circuit selects a suitable operating mode for the print head in accordance with the comparison. Thus, burnout of the print head can be prevented without reducing the operating efficiency of the printer.

44 Claims, 8 Drawing Sheets

| Mode / Rank | 1off | 1on | 2off | 2on |
|---|---|---|---|---|
| a | 06EH | 06FH | 070H | 071H |
| b | 06AH | 06BH | 06DH | 06EH |
| c | 067H | 068H | 069H | 06AH |
| d | 064H | 065H | 066H | 067H |

DRIVE COIL PROTECTION APPARATUS AND METHOD AND PRINTER INCORPORATING THE APPARATUS

BACKGROUND OF THE INVENTION

The present invention relates to a drive coil protection apparatus and method for preventing drive coils from burning out as well as the dot matrix printer incorporating the protection circuit.

Printers are used as terminals for computer systems and for printing slips and receipts. Because of their low cost and relatively fast printing speed, dot matrix printers are used in many fields to print characters, numbers, etc., in dot matrix utilizing wires driven by coils. However, when the printing frequency is high, the temperature rises because of the heat generated from the coils. As a result, the print head often burns out. Thus, the temperature of the print head must be monitored frequently and inexpensively.

FIG. 8 shows an example of how the temperature is monitored in a print head in prior art. In this example, a temperature detector 19, such as a thermistor, is attached to a rear surface 10*a* of a print head 10. A warning sound is generated when it is determined from the changes in the resistance value of temperature detector 19 that a predetermined temperature has been reached, whereby the decrease in the printing frequency of the printer is urged to prevent burnout of print head 10.

Another example is disclosed in U.S. Pat. No. 5,042,375, entitled "Device for Temperature Control of a Print Head or of a Hammer Block Including an Electromagnetic Coil." The device detects the changes in temperature by measuring the increment in the resistance value of the head drive coil.

However, in the first example above, temperature detector 19, which is mounted on the outside of the print head, cannot accurately detect the internal temperature of the print head, particularly that of the coil which contributes most of the generated heat and is most susceptible to burnout, because of the thermal resistance of the print head case. Therefore, it is difficult to set a thermal threshold at which a warning sound, for example, should be generated. If the tolerances for the thermal threshold are small, warnings will be generated more than necessary, thus decreasing the operating efficiency of the printer. On the other hand, if the tolerances are too large, burnout may already have occurred before a warning sound is generated. Also, if a warning sound is generated and the operator fails to reduce the printing frequency of the printer, the print head will burn out. Furthermore, a space around the print head is needed for mounting the thermistor or other temperature detection element. However, in recent years the compactness of printers has been emphasized and it is desirable that a temperature detection means can be disposed within a compact printer.

In the second example above, the drive coils in different print heads have different tolerances in the thermal-resistance character. The tolerances depend on the physical dimensions of the drive coils and are caused by various factors in the manufacturing process. Therefore, the print heads are classified based on the thermal-resistance character of the drive coils. Alternatively, the resistance thresholds of the drive coils, at which the heat reduction sequence starts, are changed according to the thermal-resistance character of drive coils in order to protect the drive coils. However, mass-productivity is reduced by the classification of print heads or the alteration of the thresholds.

To solve the above problems, the invention provides a drive coil protection apparatus and method and a printer incorporating the apparatus that can prevent burnout of the print head without reducing the printing efficiency and the mass-productivity.

SUMMARY OF THE INVENTION

The present invention provides an apparatus for protecting drive coils in a print head of a printer. According to one aspect of the invention, first memory means, such as a rank memory, stores a preset rank value associated with a reference drive coil in the print head of a printer. The preset rank value characterizes inherent deviations associated with the reference drive coil. The invention uses rank values to take into account of the fact that individual print heads may have drive coils with different electrical properties, tolerances, etc. resulting from the manufacturing process, etc. These deviations can affect measurements of the internal temperature of the print head. By using the rank values for the reference drive coil, additional tolerances need not be added to the measured temperature-related value, thus providing accurate measurements. In one embodiment, the drive coil which operates at the slowest speed is used as the reference drive coil because its temperature approximates the average internal temperature of the print head.

According to another aspect of the invention, second memory means, such as a judgment value memory, stores a plurality of sets of mode judgment values. Each set of mode judgment values corresponds to a particular rank value, and each mode judgment value represents a threshold value. These threshold values are used to determine the thermal condition of the print head so that when the internal temperature of the print head reaches a particular threshold value, the operating mode of the print head can be appropriately adjusted.

According to a further aspect of the invention, detecting means, such as a head information detector, detects a present value indicative of the current temperature of the reference drive coil. In one embodiment of the invention, the head information detector includes a measurement control circuit which receives a timing signal from the printer and a measurement circuit which measures the present value in response to the timing signal. The present value is measured by measuring the voltage drop across the reference drive coil and then converting the voltage drop to a digital value. By measuring the voltage drop across the reference drive coil, the changes in the resistance of the reference drive coil can therefore be determined. Accordingly, changes in the temperature of the drive coil can be determined.

According to a still further aspect of the invention, means for comparing and selecting, such as an operating mode selection circuit, compares the present value with a particular set of mode judgment values in the judgment value memory corresponding to the preset rank value. Then, the operating mode selection circuit selects a suitable operating mode for the print head in accordance with the comparison. In one embodiment of the invention, there are three operating modes, mode 0, mode 1 and mode 2, for the print head. In mode 0, the printer operates normally, and the print head prints in both left and right directions. When the temperature of the reference drive coil becomes high, the print head operates in mode 1, and prints only in the left-to-right direction. In this mode, the print head does not print on return in order to cool down the temperature. When the temperature of the reference drive coil becomes excessively high, the print head operates in mode 2, and the print head stops printing in order to prevent burnout. Printing is resumed after the temperature of the reference drive coil falls below a particular value as indicated by the decrease in the voltage drop of the reference drive coil below a particular threshold value, or mode judgment value According to a still further aspect of the invention, setting means, such as a rank setting circuit, includes third memory means which stores a plurality of rank judgment values. Each rank judgment value represents a value of the voltage drop at a particular temperature for a particular rank value. The rank setting circuit also includ4s generating means, such as a rank comparison circuit and an output circuit which generate a plurality of rank values and a plurality of corresponding temperature ranges based on the present value. Thus, an operator can select an appropriate rank value in the rank memory in accordance with the current room temperature. In an alternative embodiment, the printer itself can automatically select and set an appropriated rank value in the rank memory based on the current room temperature.

The invention also provides a drive coil protection method. According to the method, a preset rank value associated with a reference drive coil in the print head in first memory means is stored. The present value characterizes inherent deviations associated with the reference drive coil. A plurality of sets of mode judgment values are stored in second memory means. Each set of mode judgment values corresponds to a particular rank value. Each mode judgment value represents a threshold value. A present value indicative of the current temperature of the reference drive coil is detected. The present value and a particular set of mode judgment values in the second memory means corresponding to the preset rank value are compared. A suitable operating mode for the print head is thereby selected in accordance with the comparison.

The invention further provides a printer incorporating the drive coil protection apparatus of the invention. The printer includes a print head containing a plurality of printing means and associated drive coils for driving the printing means. First control means controls drive means to drive the drive coils. First memory means stores a preset rank value associated with a reference drive coil in the print head. The preset rank value characterizes inherent deviations associated with the reference drive coil. Second memory means stores a plurality of sets of mode judgment values. Each set of mode judgment values corresponds to a particular rank value. Each mode judgment value represents a threshold value. Detecting means responsive to the first control means detects a present value indicative of the current temperature of the reference drive coil. Select means compares the present value with a particular set of mode judgment values in the second memory means corresponding to the preset rank value and selects a suitable operating mode for the print head in accordance with the comparison. Second control means responsive to the select means controls the print head to operate in the suitable operating mode.

Therefore, the present invention can effectively prevents the drive coils from burning out without reducing the operating efficiency of the printer.

DESCRIPTION OF THE PREFERRED EMBODIMENTS

Figure 1:
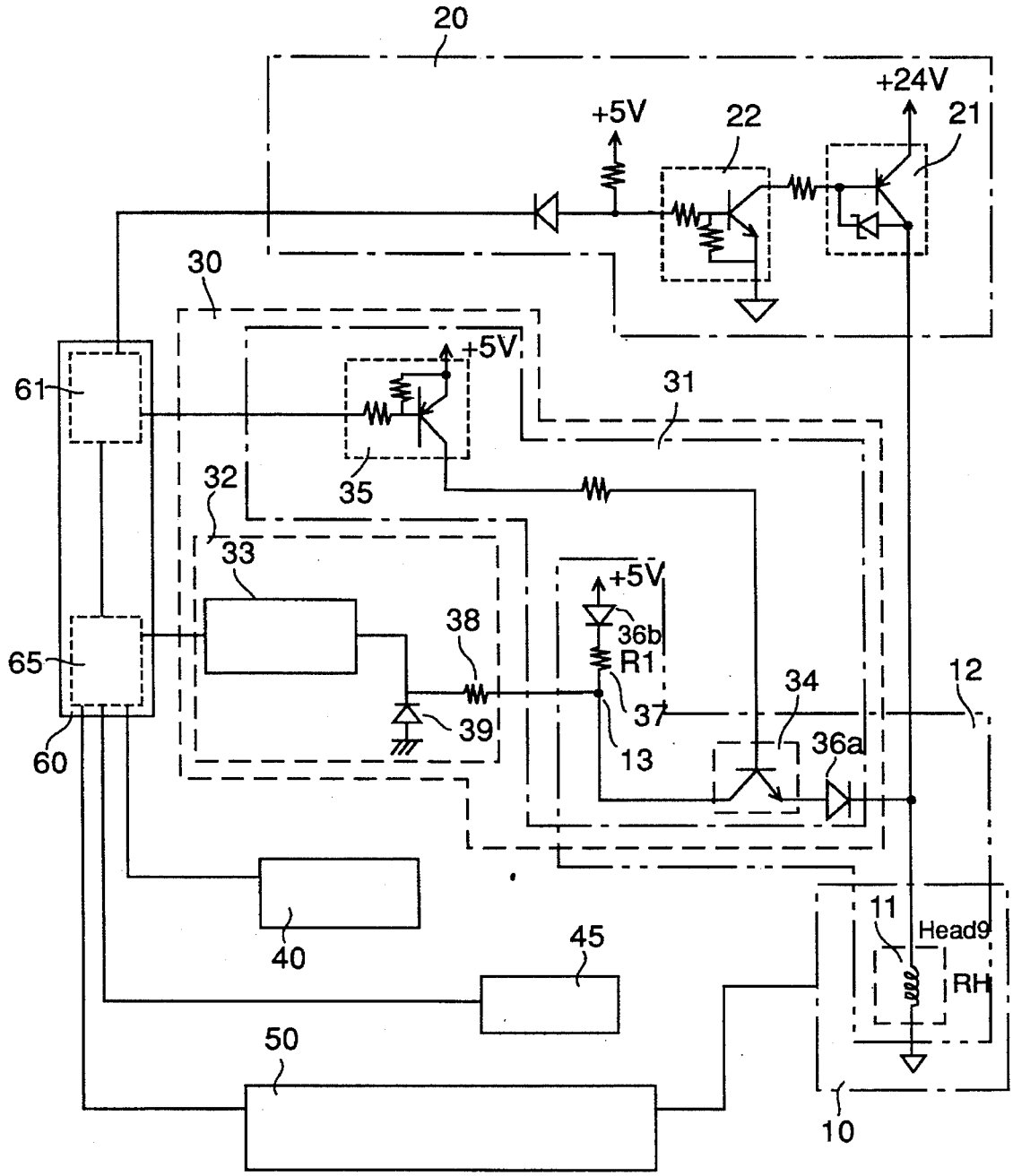
FIG. 1 is a circuit diagram of the controller of the printer of according to an embodiment of the invention.

FIG. 1 shows the controller of the printer according to the invention. The controller controls the printer by controlling the operation of a print head 10 of the printer. Printer head 10 has nine drive coils or head coils, for example, for driving the dot wires in the printer to perform dot matrix printing. Of the nine head coils, only the ninth head coil 11 is shown in FIG. 1. The ninth head coil 11 operates at the slowest speed and thus has a temperature that is most suitable for representing the average internal temperature of the print head. The controller monitors the internal temperature of print head 10 by measuring the resistance value of head coil 11.

The controller comprises a drive controller 20, a head information detector 30, a judgment value memory 40, a rank memory 45 in the form of DIP switches 45, a line drive circuit 50, and a printer control circuit 60. In operation, drive controller 20 provides a drive voltage to print head 10 for printing according to commands from printer control circuit 60, which also sets the timing for measuring the resistance value of head coil 11. Head information detector 30 detects the resistance value of head coil 11 by measuring the associated voltage drop at point 13. The voltage drop is then converted by an A/D converter 33 and output as a digital value AD. Printer control circuit 60 compares the digital value AD with a particular set of mode judgment values MD stored in judgment value memory 40. The particular set of mode judgment values MD corresponds to a particular rank preset in DIP switches 45 for the particular head coil 11 in print head 10. The rank is determined by taking into account of the fact that different print heads may have different head coils 11 which have individual differences in their electrical properties, tolerances, etc. The comparison results are then used to select an operating mode and line drive circuit 50 drives print head 10 according to the selected operating mode.

Printer control circuit 60 includes a printing control circuit 61 and an operating mode selection circuit 65. Printing control circuit 61 controls the printing by print head 10. Operating mode selection circuit 65 monitors the thermal condition of print head 10 by comparing the digital value AD from head information detector 30 with the particular set of mode judgment values stored in judgment value memory 40 corresponding to the particular rank preset in rank memory 45. Operating mode selection circuit 65 then selects the appropriate operating mode for line drive circuit 50 to drive the print head.

Drive controller 20 includes a drive switch 21 and a control switch 22, both of which are made of transistors. Control switch 22 receives a control signal from printing control circuit 61 and drives switch 21 to provide 24 volts to print head 10 for driving the head coils accordingly. The dot wires (not shown) are then driven by the electromagnets which include the head coils to perform dot matrix printing.

Head information detector 30 comprises measurement control circuit 31 and measurement circuit 32. Measurement control circuit 31 supplies measuring current to head coil 11 in response to a timing signal from printing control circuit 61. Measurement circuit 32 detects the resistance value of head coil 11 by measuring the voltage drop at a voltage division point 13 of voltage divider circuit 12. In measurement control circuit 31, a connection switch 34 in the form of an NPN transistor connects head coil 11 to measurement circuit 32. A switch 35 in the form of a PNP transistor drives connection switch 34 in accordance with a timing signal from printing control circuit 61. Reverse current flow is prevented by a diode 36*a*. Further, a voltage division resistor 37 having a resistance value of R1 is connected in series with a thermal compensation diode 36*b*. Resistor 37 is also connected in series with head coil 11 having a resistance value of RH via connection switch 34. A 5-volt constant voltage is supplied to connection switch 34. Measurement circuit 32 includes a transfer resistor 38, a diode 39 and A/D converter 33. The voltage value at voltage division point 13 is sent to A/D converter 33, which converts the voltage value to an 8-bit digital value AD and outputs it to printer control circuit 60.

Judgment value memory 40 stores a plurality sets of mode judgment values MD including MDa, MDb, MDc and MDd corresponding to four ranks of head coil 11. A particular rank that is suitable for the particular head coil 11 in print head 10 is preset in DIP switches 45. A particular set of mode judgment values corresponding to the particular rank is then selected by control circuit 60 for determining the thermal condition of print head 10 in conjunction with the digital value AD from A/D converter 33.

Line drive circuit 50 in this embodiment can be driven in three operating modes. The first mode, mode 0, is the normal operating mode of the printer in which printing is performed by driving the print head in both directions, i.e., left and right directions.

The second mode, mode 1, is an operating mode in which the head has a lower drive duty cycle than that in mode 0. This mode is selected when the voltage drop of head coil 11 is increased, i.e., when the temperature of head coil 11 is increased. In this mode, printing is performed by driving print head 10 only in the left-to-right direction. On return printing is not performed in order to allow the temperature of the print head to cool down.

The third mode, mode 2, is used to prevent burnout when the voltage drop of head coil 11 is large, i.e., when the temperature of head coil 11 is excessively high. In this mode, the printing operation of print head 10 is stopped but is resumed after the voltage drop of head coil 11 falls below a prescribed value.

In this way, a constant voltage of 5 volts is provided to head coil 11 through voltage division resistor 37 by head information detector 30 when the drive voltage of 24 volts is not being supplied to the head coil. As described above, the voltage drop of head coil 11 is measured by detecting the voltage value at voltage division point 13 by measurement circuit 32. The voltage drop is used to measure the resistance value of head coil 11 for determining the internal temperature of head coil 11 and therefore that of print head 10 since head coil 11 contributes most of the generated heat and is susceptible to burnout. The voltage value V detected by measurement circuit 32 can be expressed by the following equation:

$$V=Rp(Vcc-VDb)+Rq(V1+VDa) \quad (1)$$

where $$Rp=RH/(RH+R1)$$

$$Rq=R1/(RH+R1)$$

Where RH is the resistance value of head coil 11 and fluctuates with temperature; R1 is the resistance value of voltage division resistor 37; V1 is the voltage drop in the NPN transistor used as connection switch 34; VDa is the forward voltage drop of reverse current prevention diode 36*a;* and VDb represents the forward voltage drop of thermal compensation diode 36*b*. Both of VDa and VDb fluctuate with temperature. As can be seen from equation (1), if the resistance of the voltage division resistor R1 is selected to be a value near RH, the influence on the voltage value V by the thermal fluctuation of VDa can be compensated by the thermal fluctuation of VDb because both thermal fluctuations are the same.

Head coil 11, voltage division resistor 37, connection switch 34 and the wiring which is not taken into account in equation (1) all have deviations in their electrical properties, tolerances, etc. resulting from production processes, etc. These deviations differ for different printers and have a distribution that is generally expressed by an error function. Therefore, in order to keep the temperature of head coil 11 within a prescribed range and increase the operating efficiency of the printer, it is desirable to evaluate the detected voltage value V in light of the various deviations. If an analog setting device is used for this type of evaluation, the circuitry will be very complicated in order to generate a plurality of threshold values for adjusting the operating mode of the printer. Furthermore, such a circuitry will not fit in a compact printer. Additionally, since the deviations in the components will necessarily result in changes in the threshold values, tolerances have to be allowed in the threshold values. Thus, it is impossible to increase the operating efficiency of the printer by using an analog setting device.

In the invention, the detected voltage value V is digitized to become a digital value AD which is compared with the mode judgment threshold values in judgment value memory 40. Thus, the deviations caused by the printer circuitry can be reduced to the minimum and only the deviations in the head coils are taken into account. Hence, whether there is a matching between the printer circuitry and the print head mounted on the printer is disregarded.

The deviations in the head coils are taken into account by storing the plurality sets of mode judgment values MDa, MDb, MDc and MDd corresponding to the four ranks, +10%, +5%, −5% and −10% of the design value in judgment value memory 40. The rank for which the head coil or the printer is suitable is first determined. Then, the set of mode judgment values corresponding to the rank is selected by control circuit 60 and is compared with digital value AD for selecting the operating mode of print head 10. Therefore, the operating efficiency of the printer can be maintained while burnout of print head 10 is prevented.

Figure 2:
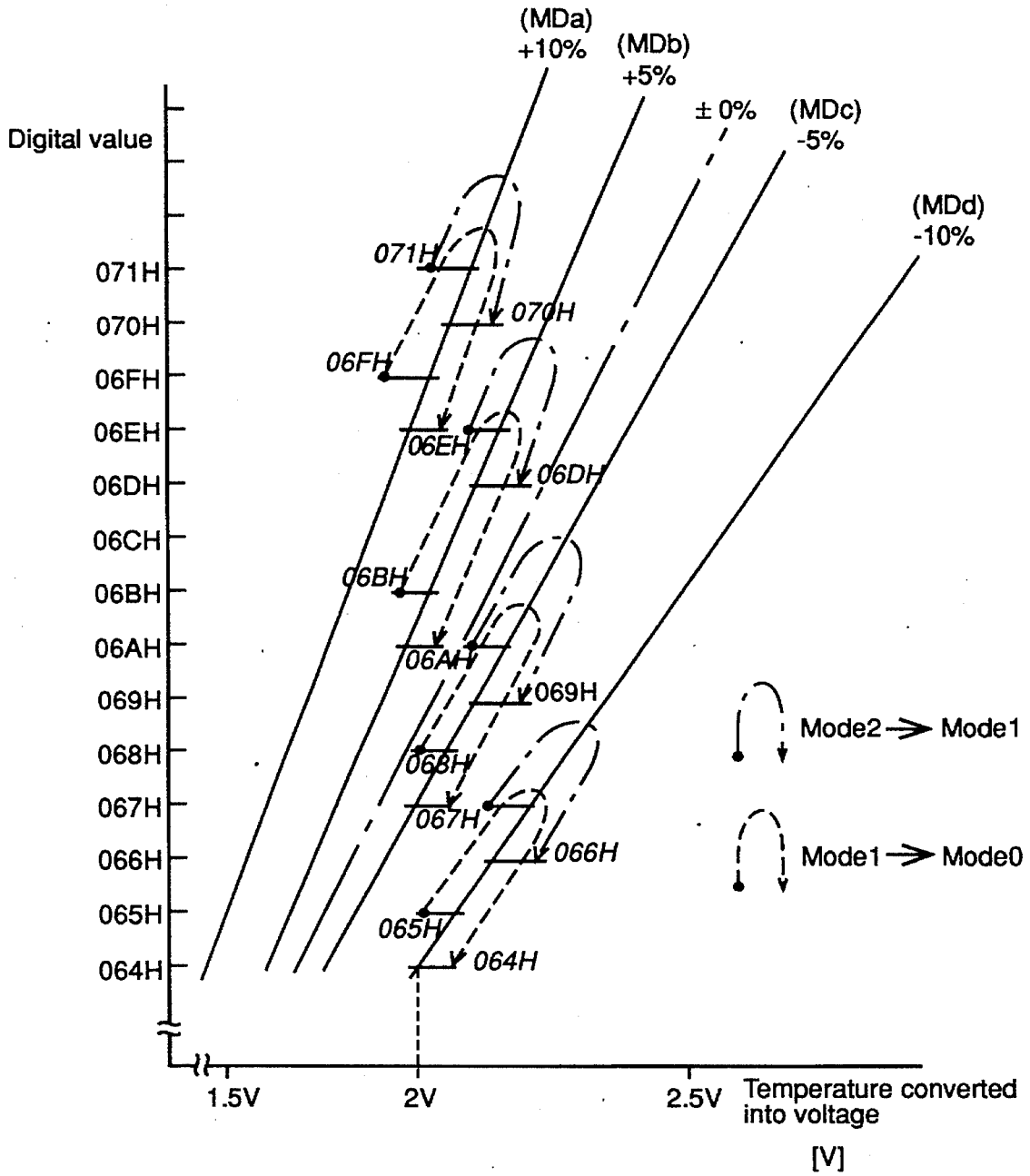
FIG. 2 illustrates the operating mode selection operation for the printer in FIG. 1.

In FIG. 2, the sets of mode judgment values with the corresponding ranks and the operating modes are shown. As an example, when a large voltage drop which is 5 percent greater than the design value is indicated by the rank decision process as will be described below, the rank of the head coil is determined to be rank B and thus the set of mode judgment value MDb is selected. When the digital value AD reaches 06 BH, the mode changes from mode 0 in which the normal bi-directional printing is performed to mode 1 in which only the left-to-right printing is performed in order to cool down the print head. When the digital value AD drops to 06 AH as a result, it is assumed that the temperature of print head 10 has returned to normal. Consequently, mode 1 is canceled and mode 0, i.e., the normal printing mode, is resumed.

However, in slowing down the drive duty cycle of print head 10 to reduce the heat generated, the heat radiation from print head 10 may be enhanced by moving it without printing. If the temperature of print head 10 does not come down and the voltage drop continues to increase such that the digital value AD reaches 06 EH from 06 BH in mode 1, the mode is changed to mode 2. In mode 2, the printer is stopped to reduce heat generated in print head 10 to prevent burnout. When the digital value AD drops to 06 DH, the mode changes from mode 2 to mode 1 and print head 10 starts to operate at a low drive duty cycle. Print head 10 continues operating in mode 1 until the digital value AD drops to 06 AH. At that time, it is assumed, as above, that the temperature of print head 10 has returned to normal, and thus mode 1 is canceled and mode 0 is resumed for normal printing. The operations for changing modes are similarly carried out for other ranks of the head coil using corresponding sets of mode judgment values.

Figure 3:
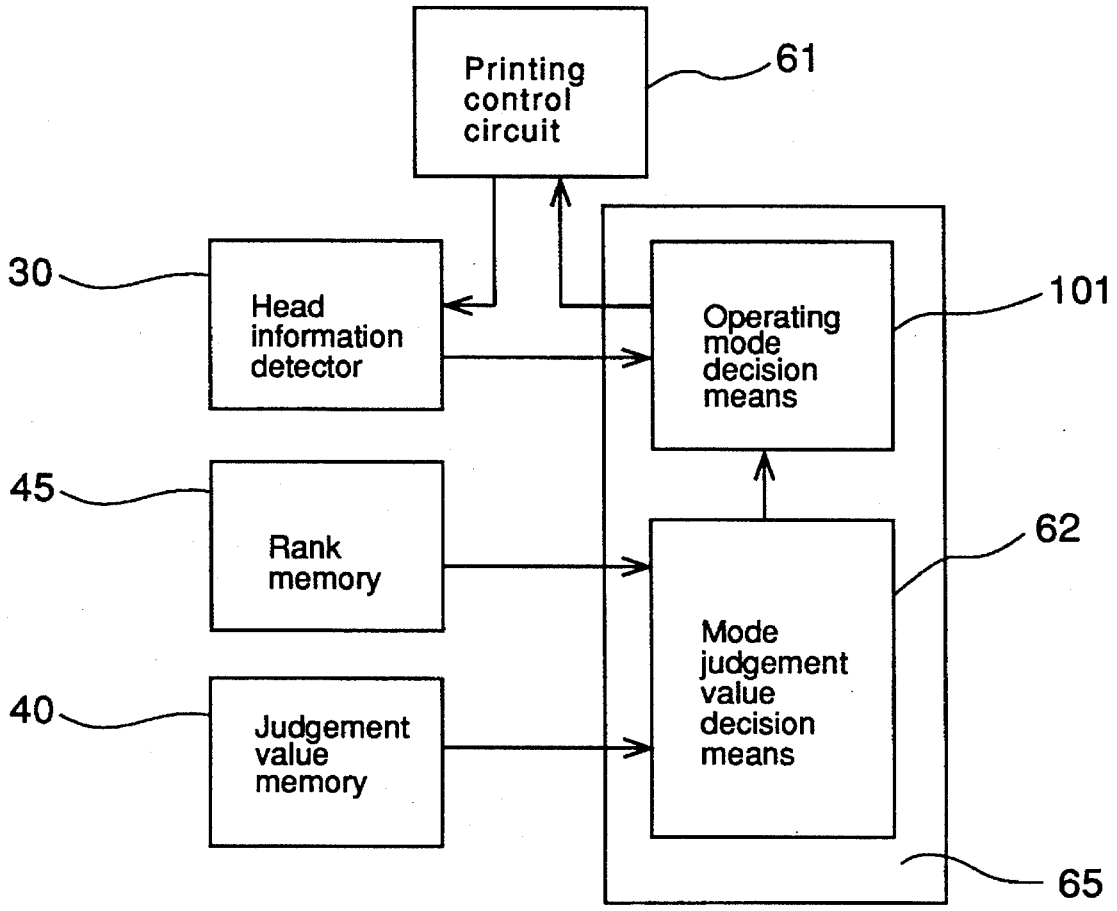
FIG. 3 is a block diagram illustrating the control method of an embodiment of the invention.

FIG. 3 is a block diagram which shows the control method of the embodiment. Operating mode selection circuit 65 includes mode judgment value decision means 62 and operating mode decision means 101. Mode judgment value decision means 62 selects the set of mode judgment values corresponding to a particular rank value stored in rank memory 45. Operating mode decision means 101 controls head information detector 30 by providing a timing signal to printing control circuit 61 to start the head information detection. The operating mode of the printer is selected by operating mode decision means 101 based on the comparison of the voltage value detected by head information detector 30 and the set of mode judgment values selected by mode judgment value decision means 62.

Figure 4:
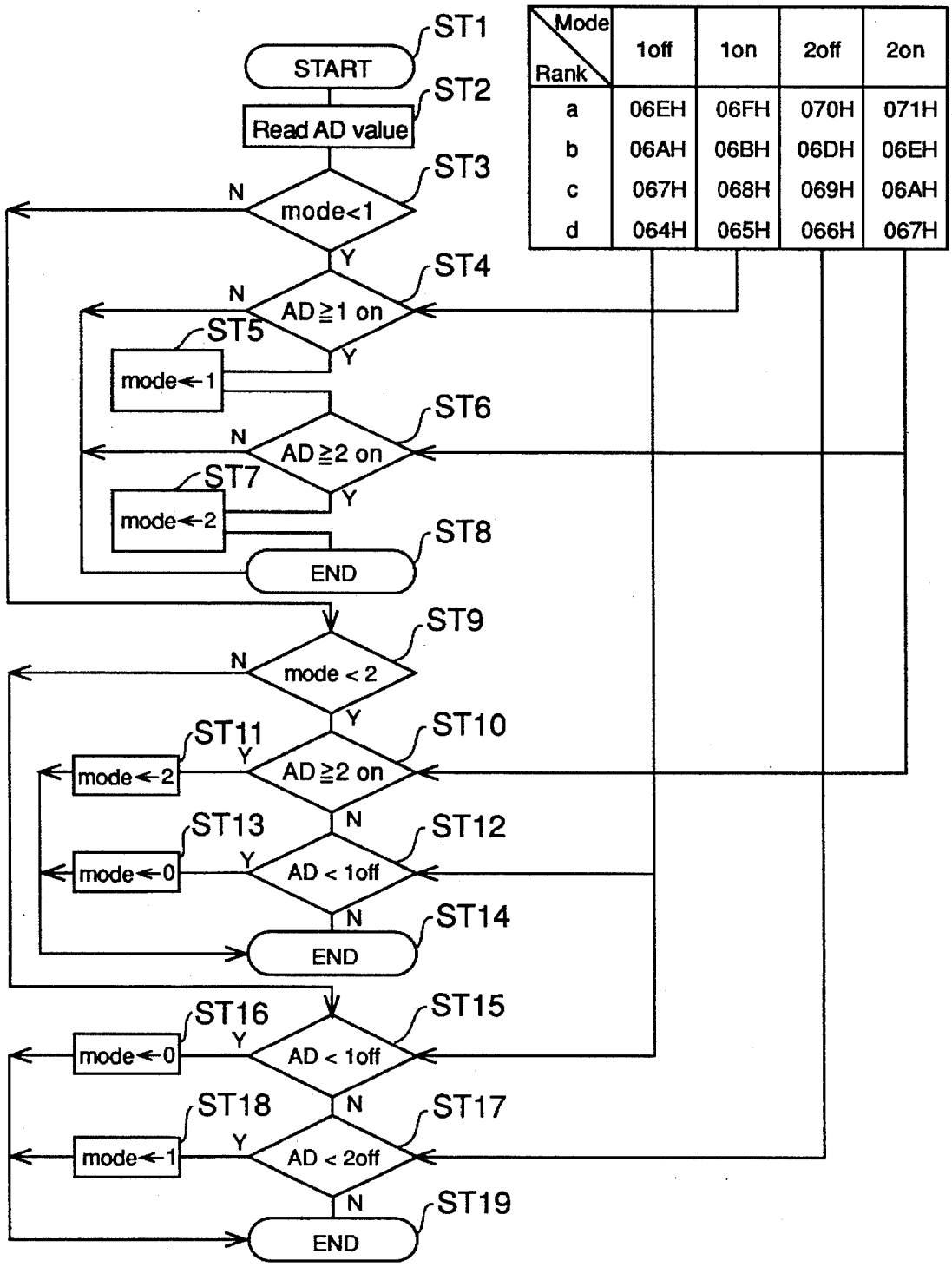
FIG. 4 is a flowchart showing the operating mode selection operation for the printer in FIG. 1.

FIG. 4 shows the operation flow by which the operating mode is selected by operating mode decision means 101. First, in step ST1, the operation is started. This operation is performed with each pass of print head 10 or at a regular, fixed interval or the combination. In step ST2, a timing signal is sent to head information detector 30 by operating mode decision means 101 through printing control circuit 61 and the digitized voltage drop AD of head coil 11 is read. Next, in step ST3, the current operating mode is detected. If the mode is not less than 1, i.e., any mode other than normal mode 0, the operation jumps to step ST9.

If the mode is less than 1, i.e., if the printer is operating in normal mode 0, then in step ST4 the digital value AD is compared with 1 on corresponding to a particular rank in rank memory 45. 1 on is a threshold value relative to the switching of the mode from mode 0 to mode 1 in the set of mode judgment values stored in judgment value memory 40. If the digital value AD is not equal to or greater than 1 on, the temperature of head coil 11 is not high and the mode selection operation is terminated in step ST8 with the mode unchanged at mode 0. However, if the digital value AD is equal to or greater than 1 on, the temperature of head coil 11 is high and the mode is set to mode 1 in step ST5. Then, in ST6 the digital value AD is compared with 2 on which is a threshold value relative to the switching of the mode from mode 1 or mode 0 to mode 2 in the set of mode judgment values. If the digital value AD is not equal to or greater than 2 on, the temperature of head coil 11 is not too high and the mode selection operation is terminated in step ST8 with the mode unchanged at mode 1. However, if the digital value AD is equal to or greater than 2 on, the temperature of head coil 11 is too high and the mode is set to mode 2 in step ST7. Then, the mode selection operation is terminated in step ST8.

If the mode is not less than 1, i.e., if either mode 1 or mode 2 is set at the beginning of the mode selection operation, then the mode is further determined in step ST9. If the mode is not less than 2, i.e., mode 2 is set, the operation goes to step ST15. If the mode is less than 2, i.e., mode 1 is set, then the digital value AD is compared with 2 on in step ST10. If the digital value AD is equal to or greater than 2 on, the temperature of head coil 11 is too high and the mode is set to mode 2 in step ST11. Then, the mode selection operation is terminated in step ST14. However, if the digital value AD is not equal to or greater than 2 on, then in step ST12 the digital value AD is compared with 1 off which is a threshold value relative to the switching of the mode from mode 1 or mode 2 to mode 0 in the set of mode judgment values. If the digital value AD is less than 1 off, it is assumed that the temperature of head coil 11 has returned to normal. Thus, mode 1 is canceled and mode 0 is set. The mode selection operation is then terminated in step ST14. However, if the digital value AD is not less than 1 off, the temperature of head coil 11 is still high and the mode remains at mode 1. Then, the mode selection process is terminated in step ST14.

In step ST9, if the mode is not less than 2, i.e., if mode 2 is already set, when the mode selection operation is started, then the digital value AD is compared with 1 off in ST15. If the digital value AD is less than 1 off, the temperature of head coil 11 has returned to normal. Thus, mode 2 is canceled and the normal operating mode 0 is set in step ST16. The mode selection operation is then terminated in step ST19. If, however, the digital value AD is not less than 1 off, then in step ST17 the digital value AD is compared with 2 off which is a threshold value relative to the switching of the mode from mode 2 to mode 1. If the digital value AD is less than 2 off, the temperature of head coil 11 has dropped from an excessively high condition to a high condition. Thus, mode 2 is canceled and mode 1 is set in step ST18. Then, the mode selection operation is terminated in step ST19. If the digital value AD is not less than 2 off, the temperature of head coil 11 is still excessively high and the mode remains at mode 2. Then, the mode selection operation is terminated in step ST19. Here, 1 off, 1 on, 2 off and 2 on represent a set of mode judgment values which is also illustrated in FIG. 2.

In this way, an operating mode suitable for the thermal condition of the print head is selected to prevent burnout and to allow the printing to continue.

Figure 5:
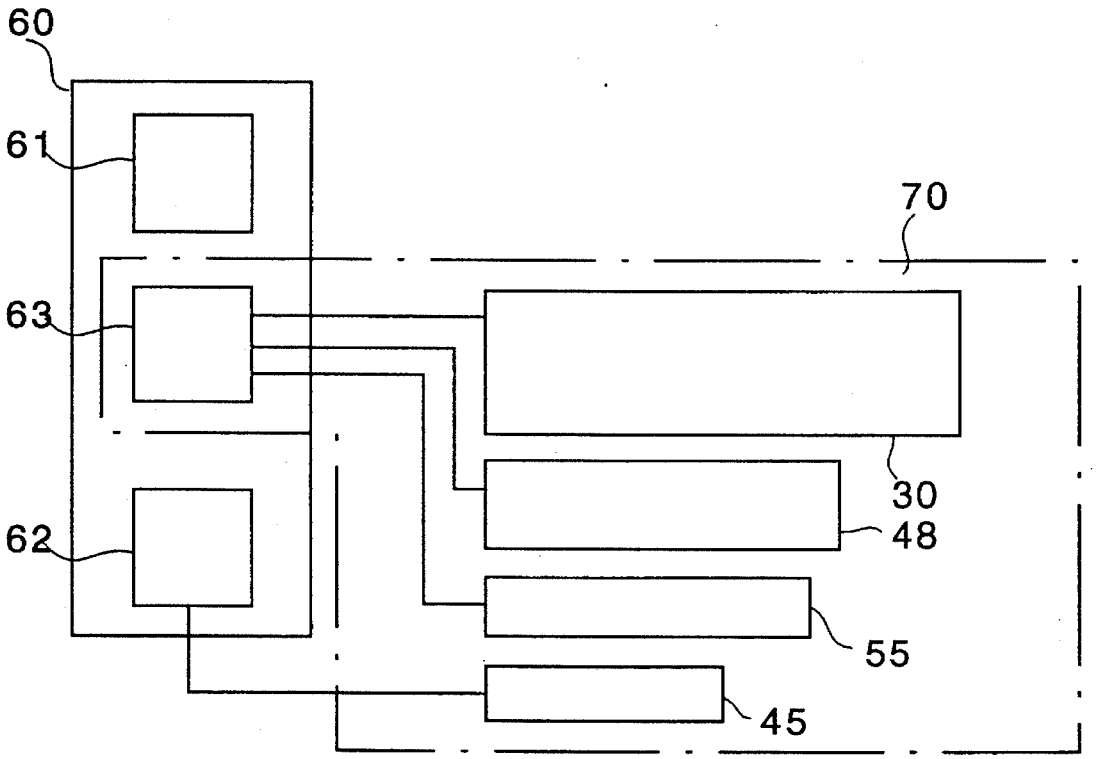
FIG. 5 is a block diagram of a rank setting circuit for the printer of the invention.
Figure 6:
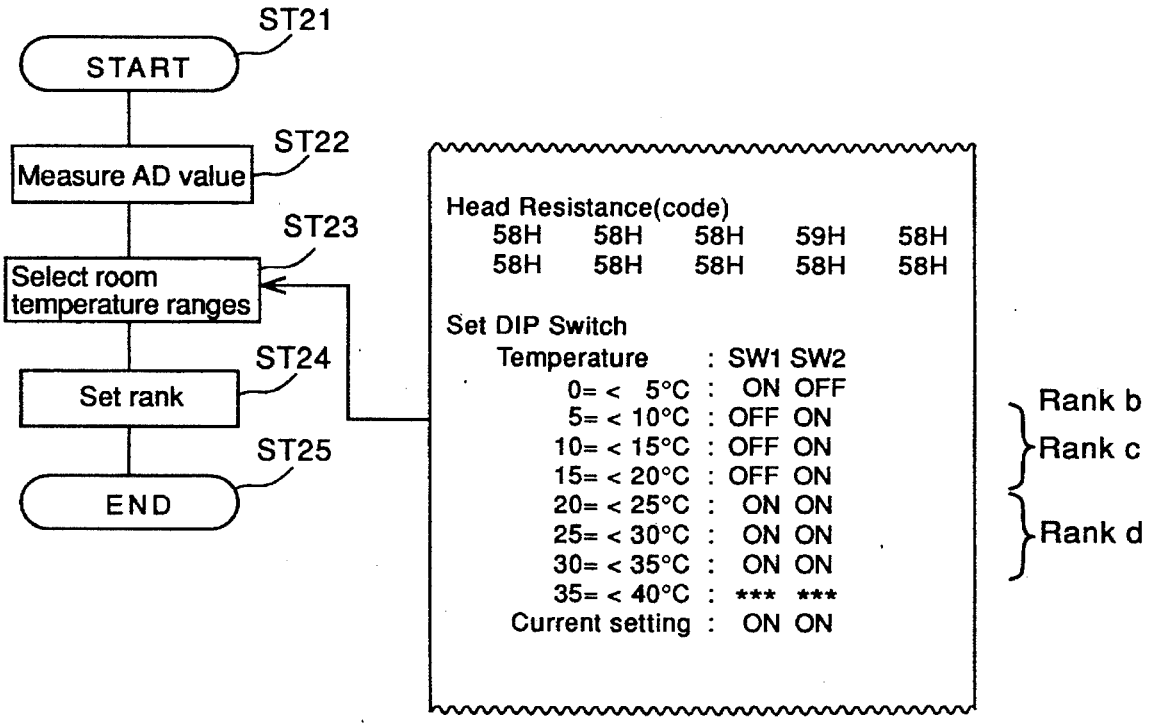
FIG. 6 is a flowchart showing the operation flow of the ranking setting circuit in FIG. 5.
Figure 7:
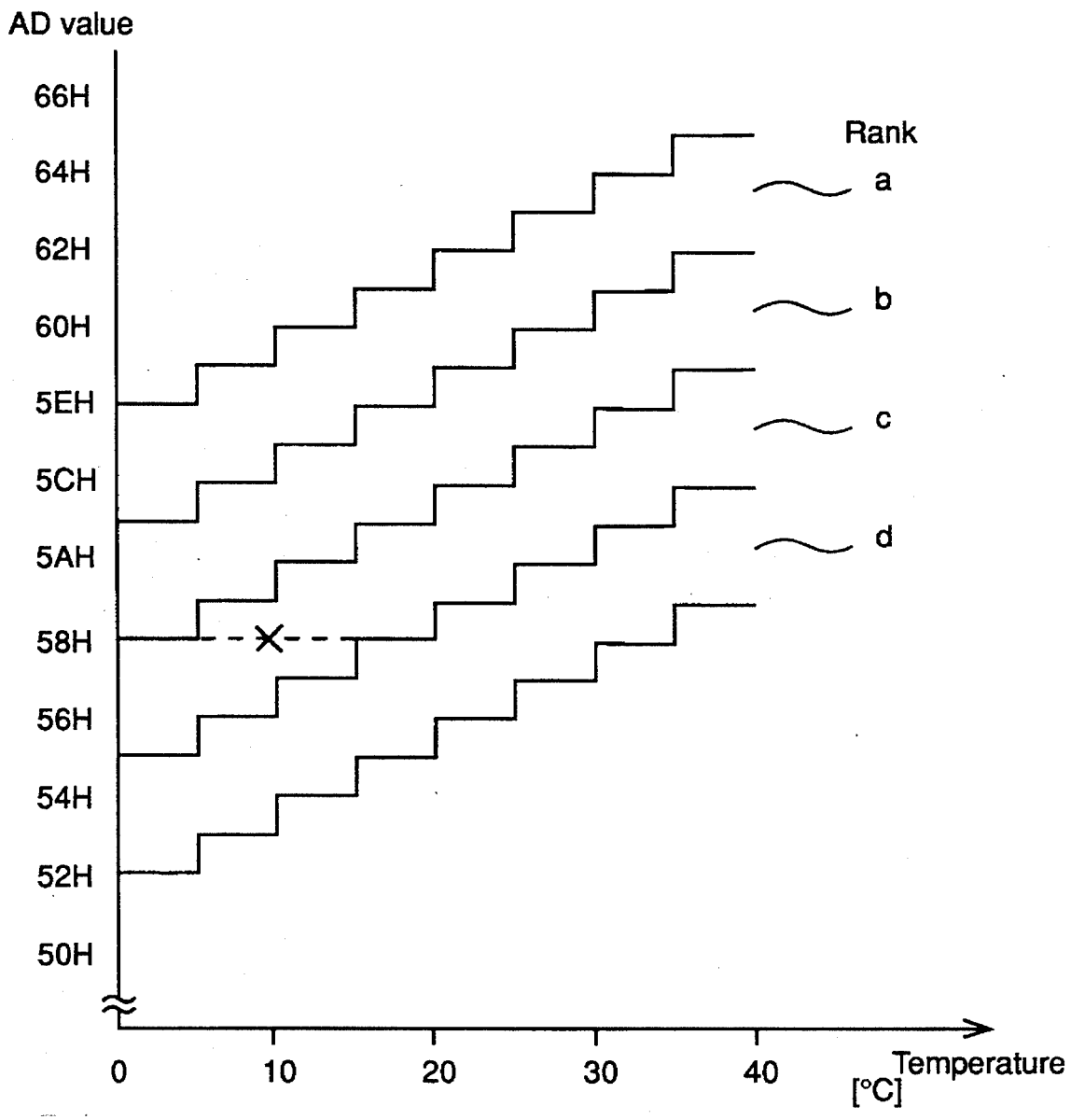
FIG. 7 shows the rank judgment values for all the ranks and the corresponding temperature ranges.
Figure 8:
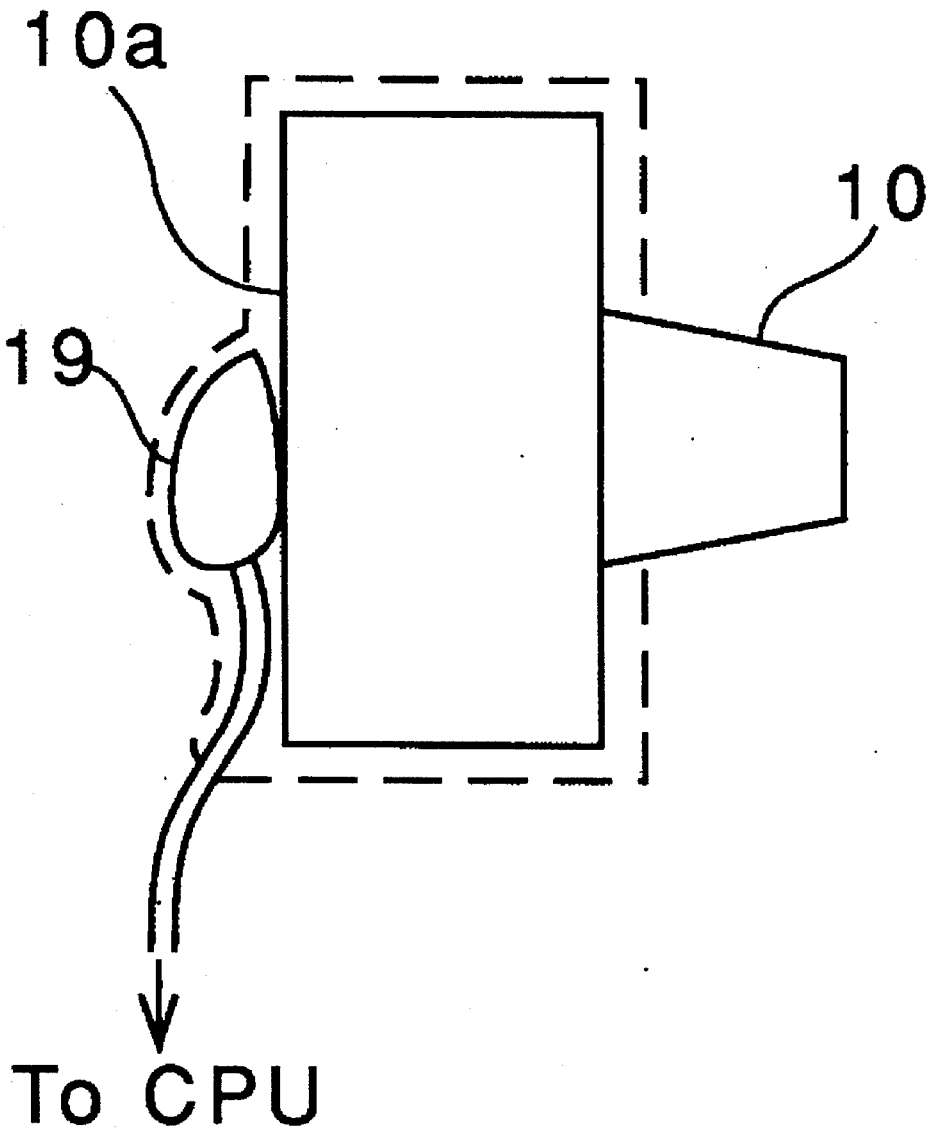
FIG. 8 (PRIOR ART)
FIG. 8 shows an example of measuring the temperature of the print head in a printer in prior art.

In the printer of this embodiment, a particular set of mode judgment values is selected according to the rank set in DIP switches 45. FIG. 5 shows a rank setting circuit 70 that can be incorporated in the controller of FIG. 1 to set the rank in DIP switches 45. FIG. 6 shows the operation flow of rank setting circuit 70. FIG. 7 illustrates the rank judgment values for all the ranks and the corresponding temperature ranges.

In rank setting circuit 70 shown in FIG. 5, the digital value AD, which is related to the resistance value of head coil 11 at the ambient temperature (room temperature), is measured using head information detector 30 as described above. The rank judgment values for all ranks as shown in FIG. 7 are stored in a rank judgment value memory 48. The digital value AD and the rank judgment values are compared in a rank comparison circuit 63 in printer control circuit 60. The results are output to output circuit 55. It is also possible to display the results using an LCD or other types of display panels. Output circuit 55 prints out the digital value AD, the room temperature ranges corresponding to the digital value AD for each rank and the setting which the operator should select in DIP switches 45. Then, the operator can set the appropriate rank in DIP switches 45 by referring to the printout using the room temperature as a reference.

In FIG. 6, the operation flow of rank setting circuit 70 is illustrated. When the rank setting operation is started in step ST21, it is necessary to first confirm that the printer is in a rest condition in which printing is not performed and the temperature of print head 10 is the same as the room temperature. In this way, rank setting circuit 70 can use the room temperature as a reference to set the rank to reflect the individual differences in print head 10. Next, in step ST22, head information detector 30 measures the digital value AD in the rest condition several times. Then, the lowest digital value AD is selected so that a lower rank will be selected and the threshold point for changing the operating mode does not become too large to ensure adequate protection for the head coils. In step ST23, room temperature ranges corresponding to the ranks are set out based on the digital value AD and the data stored in rank judgment value memory 48 as shown in FIG. 7. Then, the measured digital value AD, the room temperature ranges and the corresponding ranks are output from display section 55 along with the setting patterns for SW1 and SW2 in DIP switches 45. Next, in step ST24, the operator sets the rank corresponding to the digital value AD in DIP switches 45 by referring to the printout using the room temperature as a reference. For example, if the digital value AD is 058 H, SW1 and SW2 in DIP switches 45 should be set to off and on, respectively, assuming the room temperature is 10° C. Therefore, the set of mode judgment values MDc, which is associated with the −5 percent rank, is selected for operating mode decision means 101 to determine the appropriate operating mode for the print head.

In the above embodiment, rank settings are done through DIP switches, but an EEPROM, MNOS or other types of semiconductor memory can also be used for this purpose. In such a case, it is possible to let the printer determine and set the rank by itself by measuring the room temperature using thermal detection components such as thermistors mounted on the printer. Thus, the reliability of the rank decision process is enhanced and the time cycle of the process is shortened. In the embodiment described above, the digital value AD and the room temperature ranges for the ranks are printed out in the output section. However, it is possible to only display the rank to be set on a liquid crystal display, for example.

In this invention, it is possible to select the appropriate operating mode by measuring and taking into account the inherent deviations in the print head in advance using the mode judgment values. Therefore, burnout of the print head can be effectively prevented without reducing the operating efficiency of the printer since the thermal condition of the print head can be monitored using the low-tolerance mode judgment values.

Since the rank associated with a particular print head can be examined at any time in the above manner, the aged deterioration of the particular print head and the measurement control circuit 31 can be monitored by periodically repeating the above operation to confirm the rank as set. Specifically, when the values specific to the print head change significantly or there are some problems with respect to the measurement control circuit 31, the ranking fluctuates. In such a case, a failure diagnosis can be performed as above. Furthermore, since the printer itself can set the rank for the print head, the same operation as above can be performed to set the rank for a new print head when it needs to be replaced so that the printer can continue operating at a high level of efficiency.

In this invention, the printer can operate in three operating modes mode 0, mode 1 and mode 2, but the number of the operating modes can be increased or decreased depending on the operating conditions of the printer. Further, although only left-to-right printing is performed in the intermediate operating mode (mode 1) in the embodiment described above, a variety of operating modes can be employed such as dividing the character printing pattern into upper and lower portions so that it takes two passes to complete one line of printing, reciprocating the print head between a wider distance than the printing area or running a fan.

While the present invention has been described in conjunction with several specific embodiments, it is evident to those skilled in the art that many further alternatives, modifications and variations will be apparent in light of the foregoing description. For example, the drive coil protection apparatus and method can also be utilized for stepping motors, voice coil motors, dc motors, or any other devices with drive coils. Thus, the present invention described herein is intended to embrace all such alternatives, modifications, applications and variations as may fall within the spirit and scope of the appended claims.

What is claimed is:

1. An apparatus for protecting drive coils in a print head of a printer, comprising:

first memory means for storing a preset rank value associated with a reference drive coil in the print head, the preset rank value characterizing inherent deviations associated with an electrical characteristic of the reference drive coil;

second memory means for storing a plurality of sets of mode judgment values, each set of mode judgment values being associated with a rank value of the reference drive coil, each mode judgment value representing a temperature dependent threshold value for selection of an operating mode for the print head;

means for detecting a present value indicative of the electrical characteristic of the reference drive coil at current temperature, the electrical characteristic of the reference drive coil being temperature dependent;

means, responsive to said detecting means, for comparing the present value with a selected set of mode judgment values in said second memory means, the selected set of mode judgment values being associated with the preset rank value stored in said first memory means; and means for selecting a suitable operating mode for the print head in accordance with the comparison.

2. The apparatus of claim 1 wherein said detecting means comprises:

measurement control means for receiving a timing signal from the printer; and measurement means for measuring the present value in response to the timing signal.

3. The apparatus of claim 2 wherein said measurement means includes means for measuring the voltage drop across the reference drive coil.

4. The apparatus of claim 3 wherein said measuring means further includes means for converting the voltage drop to a digital value representative of the present value.

5. The apparatus of claim 4 further comprising means for setting a rank value in said first memory means.

6. The apparatus of claim 5 wherein said setting means comprises:

third memory means for storing a plurality of rank judgment values, each representing a value of the voltage drop at a particular temperature for a particular rank value; and means, responsive to said converting means and said third memory means, for generating a plurality of rank values and a plurality of associated temperature ranges based on the present value for selection of an appropriate rank value in said first memory means by an operator in accordance with the current room temperature.

7. The apparatus of claim 6 wherein said setting means further comprises means responsive to said generating means for displaying said plurality of rank values and said plurality of associated temperature ranges.

8. The apparatus of claim 5 wherein said setting means comprises:

third memory means for storing a plurality of rank judgment values, each representing a value of the voltage drop at a particular temperature for a particular rank value;

means, responsive to said converting means and said third memory means, for generating a plurality of rank values and a plurality of associated temperature ranges based on the present value; and means, responsive to said generating means, for selecting an appropriate rank value in said first memory means based on the current temperature.

9. A printer, comprising:

a print head containing a plurality of printing means and associated drive coils for driving the printing means;

first control means for providing control signals;

drive means, responsive to said first control means, for driving the drive coils;

first memory means for storing a preset rank value associated with a reference drive coil in the print head, the preset rank value characterizing inherent deviations associated with an electrical characteristic of the reference drive coil;

second memory means for storing a plurality of sets of mode judgment values, each set of mode judgment values being associated with a rank value of the reference drive coil, each mode judgment value representing a temperature dependent threshold value for selection of an operating mode for the print head;

means, responsive to said first control means, for detecting a present value indicative of the electrical characteristic of the reference drive coil at current temperature, the electrical characteristic of the reference drive coil being temperature dependent;

means, responsive to said detecting means, for comparing the present value with a selected set of mode judgment values in said second memory means, the selected set of mode judgment values being associated with the preset rank value stored in said first memory means; and means for selecting a suitable operating mode for the print head in accordance with the comparison; and second control means, responsive to said selecting means, for controlling said print head to operate in the suitable operating mode.

10. The printer of claim 9 wherein said detecting means comprises:

measurement control means for receiving a timing signal from said first control means; and measurement means for measuring the present value in response to the timing signal.

11. The printer of claim 10 wherein said measurement means includes means for measuring the voltage drop across the reference drive coil.

12. The printer of claim 11 wherein said measuring means further includes means for converting the voltage drop to a digital value representative of the present value.

13. The printer of claim 12 further comprising means for setting a rank value in said first memory means.

14. The printer of claim 13 wherein said setting means comprises:

third memory means for storing a plurality of rank judgment values, each representing a value of the voltage drop at a particular temperature for a particular rank value; and means, responsive to said converting means and said third memory means, for generating a plurality of rank values and a plurality of associated temperature ranges based on the present value for selection of an appropriate rank value in said first memory means by an operator in accordance with the current room temperature.

15. The printer of claim 14 wherein said setting means further comprises means responsive to said generating means for displaying said plurality of rank values and said plurality of associated temperature ranges.

16. The printer of claim 13 wherein said setting means comprises:

third memory means for storing a plurality of rank judgment values, each representing a value of the voltage drop at a particular temperature for a particular rank value;

means, responsive to said converting means and said third memory means, for generating a plurality of rank values and a plurality of associated temperature ranges based on the present value; and means, responsive to said generating means, for selecting an appropriate rank value in said first memory means based on the current temperature.

17. A method for protecting drive coils in a print head of a printer, comprising:

storing a preset rank value associated with a reference drive coil in the print head in first memory means, the preset rank value characterizing inherent deviations associated with an electrical characteristic of the reference drive coil;

storing a plurality of sets of mode judgment values in second memory means, each set of mode judgment values being associated with a rank value of the reference drive coil, each mode judgment value representing a temperature dependent threshold value for selection of an operating mode for the print head;

detecting a present value indicative of the electrical characteristic of the reference drive coil at current temperature, the electrical characteristic of the reference drive coil being temperature dependent;

comparing the present value with a selected set of mode judgment values in the second memory means, the selected set of mode judgment value being associated with the preset rank value stored in the first memory means;

selecting a suitable operating mode for the print head in accordance with the comparison.

18. The method of claim 17 wherein said detecting step comprises:

receiving a timing signal from the printer; and measuring the present value in response to the timing signal.

19. The method of claim 18 wherein said measurement step includes measuring the voltage drop across the reference drive coil.

20. The method of claim 19 wherein said measuring step further includes converting the voltage drop to a digital value representative of the present value.

21. The method of claim 20 further comprising setting a rank value in the first memory means.

22. The method of claim 21 wherein said setting step comprises:

storing a plurality of rank judgment values in third memory means, each representing a value of the voltage drop at a particular temperature for a particular rank value; and generating a plurality of rank values and a plurality of associated temperature ranges based on the present value for selection of an appropriate rank value in the first memory means by an operator in accordance with the current room temperature.

23. The method of claim 22 wherein said setting step further comprises displaying said plurality of rank values and said plurality of associated temperature ranges.

24. The method of claim 21 wherein said setting step comprises:

storing a plurality of rank judgment values in third memory means, each representing a value of the voltage drop at a particular temperature for a particular rank value;

generating a plurality of rank values and a plurality of associated temperature ranges based on the present value; and selecting an appropriate rank value in the first memory means based on the current temperature.

25. An apparatus for protecting drive coils in a print head of a printer, comprising:

memory means for storing a preset rank value associated with a reference drive coil in the print head, the preset rank value characterizing inherent deviations associated with an electrical characteristic of the reference drive coil;

means, responsive to said memory means, for producing a set of mode judgment values associated with the preset rank value, each mode judgment value representing a temperature dependent threshold value for selection of an operating mode for the print head;

means for detecting a present value indicative of the electrical characteristic of the reference drive coil at current temperature, the electrical characteristic of the reference drive coil being temperature dependent;

means, responsive to said detecting means and said producing means, for comparing the present value with the set of mode judgment values; and means for selecting a suitable operating mode for the print head in accordance with the comparison.

26. The apparatus of claim 25 wherein said detecting means comprises:

measurement control means for receiving a timing signal from the printer; and measurement means for measuring the present value in response to the timing signal.

27. The apparatus of claim 26 wherein said measurement means includes means for measuring the voltage drop across the reference drive coil.

28. The apparatus of claim 27 wherein said measuring means further includes means for converting the voltage drop to a digital value representative of the present value.

29. The apparatus of claim 28 further comprising means for setting a rank value in said memory means.

30. The apparatus of claim 29 wherein said setting means comprises:

means for storing a plurality of rank judgment values, each representing a value of the voltage drop at a particular temperature for a particular rank value; and means, responsive to said converting means and said storing means, for generating a plurality of rank values and a plurality of associated temperature ranges based on the present value for selection of an appropriate rank value in said memory means by an operator in accordance with the current room temperature.

31. The apparatus of claim 30 wherein said setting means further comprises means responsive to said generating means for displaying said plurality of rank values and said plurality of associated temperature ranges.

32. The apparatus of claim 29 wherein said setting means comprises:

means for storing a plurality of rank judgment values, each representing a value of the voltage drop at a particular temperature for a particular rank value;

means, responsive to said converting means and said storing means, for generating a plurality of rank values and a plurality of associated temperature ranges based on the present value; and means, responsive to said generating means, for selecting an appropriate rank value in said memory means based on the current temperature.

33. A printer, comprising:

a print head containing a plurality of printing means and associated drive coils for driving the printing means;

first control means for providing control signals;

drive means, responsive to said first control means, for driving the drive coils;

memory means for storing a preset rank value associated with a reference drive coil in the print head, the preset rank value characterizing inherent deviations associated with an electrical characteristic of the reference drive coil;

means, responsive to said memory means, for producing a set of mode judgment values associated with the preset rank value, each mode judgment value representing a temperature dependent threshold value for selection of an operating mode for the print head;

means, responsive to said first control means, for detecting a present value indicative of the electrical characteristic of the reference drive coil at current temperature, the electrical characteristic of the reference drive coil being temperature dependent;

means, responsive to said detecting means and said producing means, for comparing the present value with the set of mode judgment values;

means for selecting a suitable operating mode for the print head in accordance with the comparison; and second control means, responsive to said select means, for controlling said print head to operate in the suitable operating mode.

34. The printer of claim 33 wherein said detecting means comprises:

measurement control means for receiving a timing signal from said first control means; and measurement means for measuring the present value in response to the timing signal.

35. The printer of claim 34 wherein said measurement means includes means for measuring the voltage drop across the reference drive coil.

36. The printer of claim 35 wherein said measuring means further includes means for converting the voltage drop to a digital value representative of the present value.

37. The printer of claim 36 further comprising means for setting a rank value in said memory means.

38. The printer of claim 37 wherein said setting means comprises:

means for storing a plurality of rank judgment values, each representing a value of the voltage drop at a particular temperature for a particular rank value;

means, responsive to said converting means and said storing means, for generating a plurality of rank values and a plurality of associated temperature ranges based on the present value; and means, responsive to said generating means, for selecting an appropriate rank value in said memory means based on the current temperature.

39. A method for protecting drive coils in a print head of a printer, comprising:

storing a preset rank value associated with a reference drive coil in the print head in memory means, the preset rank value characterizing inherent deviations associated with an electrical characteristic of the reference drive coil;

producing a set of mode judgment values associated with the preset rank value, each mode judgment value representing a temperature dependent threshold value for selection of an operating mode for the print head;

detecting a present value indicative of the electrical characteristic of the reference drive coil, the electrical characteristic of the reference drive coil being temperature dependent;

comparing the present value with the set of mode judgment values; and selecting a suitable operating mode for the print head in accordance with the comparison.

40. The method of claim 39 wherein said detecting step comprises:

receiving a timing signal from the printer; and measuring the present value in response to the timing signal.

41. The method of claim 40 wherein said measurement step includes measuring the voltage drop across the reference drive coil.

42. The method of claim 41 wherein said measuring step further includes converting the voltage drop to a digital value representative of the present value.

43. The method of claim 42 further comprising setting a rank value in the memory means.

44. The method of claim 43 wherein said setting step comprises:

storing a plurality of rank judgment values in storing means, each representing a value of the voltage drop at a particular temperature for a particular rank value;

generating a plurality of rank values and a plurality of associated temperature ranges based on the present value; and selecting an appropriate rank value in the memory means based on the current temperature.

* * * * *

UNITED STATES PATENT AND TRADEMARK OFFICE

CERTIFICATE OF CORRECTION

| | | |
|---|---|---|
| PATENT NO. | : | 5,452,958 |
| DATED | : | September 26, 1995 |
| INVENTOR(S) | : | Kazuhisa Aruga, et al. |

It is certified that an error appears in the above identified patent and that said Letters Patent is hereby corrected as shown below:

Title page, insert --[73] Assignee: Seiko Epson Corporation, Tokyo, Japan--.

Signed and Sealed this

Twenty-second Day of February, 2000

*Attest:*

Q. TODD DICKINSON

*Attesting Officer*

*Commissioner of Patents and Trademarks*